United States Patent [19]

Husain

[11] Patent Number: 4,778,336

[45] Date of Patent: Oct. 18, 1988

[54] CUTTER PUMP SUBASSEMBLY

[75] Inventor: Iqbal Husain, Bensenville, Ill.

[73] Assignee: Weil Pump Company, Chicago, Ill.

[21] Appl. No.: 71,626

[22] Filed: Jul. 9, 1987

[51] Int. Cl.[4] ..... F04D 7/02

[52] U.S. Cl. ..... 415/121 B; 415/188; 241/46.06

[58] Field of Search ..... 415/121 B, 183, 185, 415/186, 188, 208, 213 A; 241/46.02, 46.06, 46.11, 46.17

[56] References Cited

U.S. PATENT DOCUMENTS

| | | | |
|---|---|---|---|
| 1,287,920 | 12/1918 | Duda | 415/188 |
| 2,323,382 | 7/1943 | Dibovsky | 415/188 |
| 3,096,718 | 7/1963 | Anderson | 415/121 B |
| 3,155,046 | 11/1964 | Vaughan | 415/206 |
| 3,318,248 | 5/1967 | Remboldt | 241/36 |
| 3,340,812 | 9/1967 | Schlesiger | 415/121 B |
| 3,388,671 | 6/1968 | Stokes et al. | 415/208 |
| 3,444,818 | 5/1969 | Sutton | 415/121 B |
| 3,446,151 | 5/1969 | Andersson | 415/121 B |
| 3,447,475 | 6/1969 | Blum | 415/121 B X |
| 3,560,106 | 2/1971 | Sahlstrom | 415/204 |
| 3,627,280 | 12/1971 | Fridman | 415/121 B X |
| 3,692,422 | 9/1972 | Girardier | 415/121 B |
| 3,786,996 | 1/1974 | Richter | 415/121 B X |
| 3,866,841 | 2/1975 | Iwahara | 241/46.11 |
| 3,915,394 | 10/1975 | Ferguson, Jr. | 241/185 A |
| 3,973,866 | 8/1976 | Vaughan | 415/121 B |
| 4,011,027 | 3/1977 | Selder | 415/121 B |
| 4,145,008 | 3/1979 | Wolford | 241/46.17 |
| 4,361,414 | 11/1982 | Nemes et al. | 415/83 |
| 4,402,648 | 9/1983 | Kretschmer | 415/121 B |
| 4,540,334 | 9/1985 | Stahle | 415/72 |
| 4,594,052 | 6/1986 | Niskanen | 415/121 B |

FOREIGN PATENT DOCUMENTS

| | | | |
|---|---|---|---|
| 538150 | 3/1955 | Belgium | 415/121 B |
| 608741 | 9/1948 | United Kingdom | 415/121 B |

OTHER PUBLICATIONS

Advertisement for Hydr-O-Grind series pumps.

Advertisement for Gorman-Rupp brand grinder pumps.

Advertisement for LCC series chopper pumps.

Advertisement for SGV 201-204 series pumps from Peabody Barnes.

Advertisement for Enpo Pump Company pumps.

Advertisement for FE Myers pump showing replaceable grinder impellar and shredding ring.

*Primary Examiner*—Robert E. Garrett

*Assistant Examiner*—Joseph M. Pitko

*Attorney, Agent, or Firm*—Allegretti & Witcoff, Ltd.

[57] ABSTRACT

An improved cutter pump subassembly for use in a centrifugal pump adapted for chopping and pumping an influent liquid containing solids is disclosed. In such a cutter pump, a suction inlet, discharge outlet, means for driving an impeller and a cutter pump subassembly are provided. The improved cutter pump subassembly comprises a housing, an impeller and a stationary cutter. The housing defines a pump chamber and contains the impeller. The housing also contains a centrally located suction aperture that receives the influent liquid and a spiral channel that conducts the liquid out of the housing. The impeller has a shroud and impeller vanes and is rotatably driven by the means for driving an impeller. The impeller vanes each have an outer circumferential end and an inner shearing edge. The stationary cutter is secured adjacent the suction aperture. The cutter has teeth each having at least one blade. The blades cooperate with the impeller vane shearing edges to cut solids contained in the influent liquid during rotation of the impeller.

24 Claims, 3 Drawing Sheets

Fig. 2
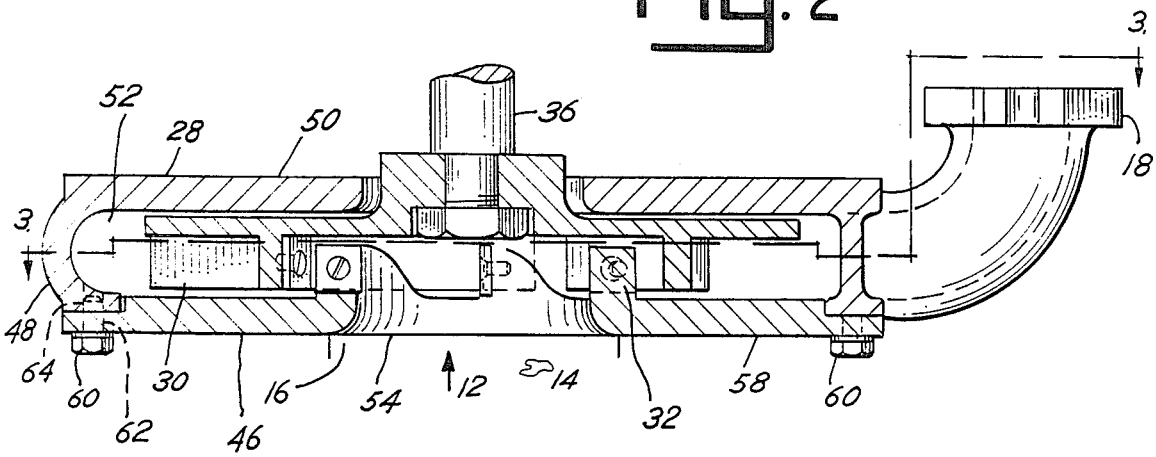
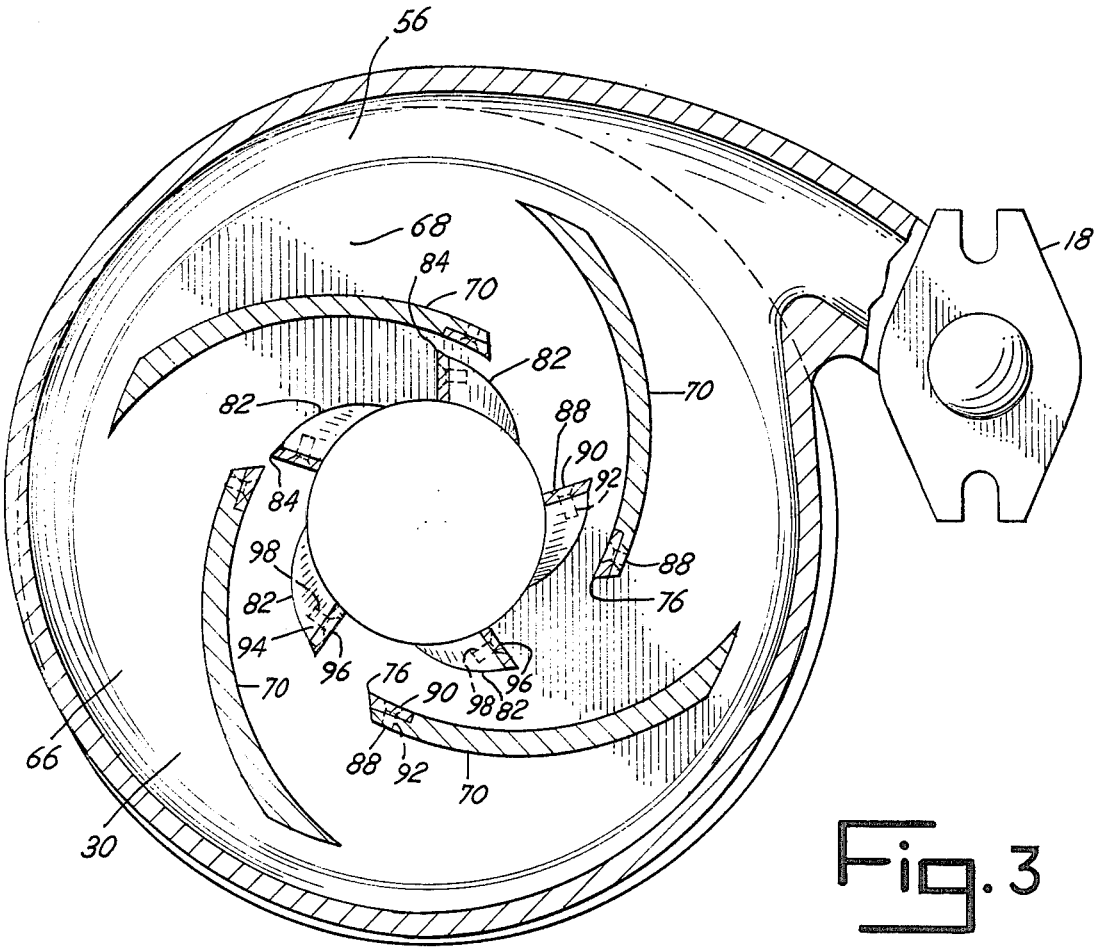
Fig. 3

Fig. 4
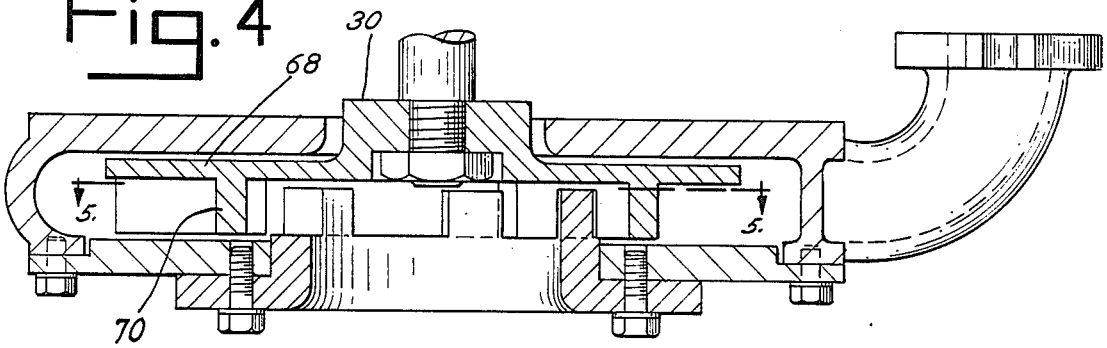
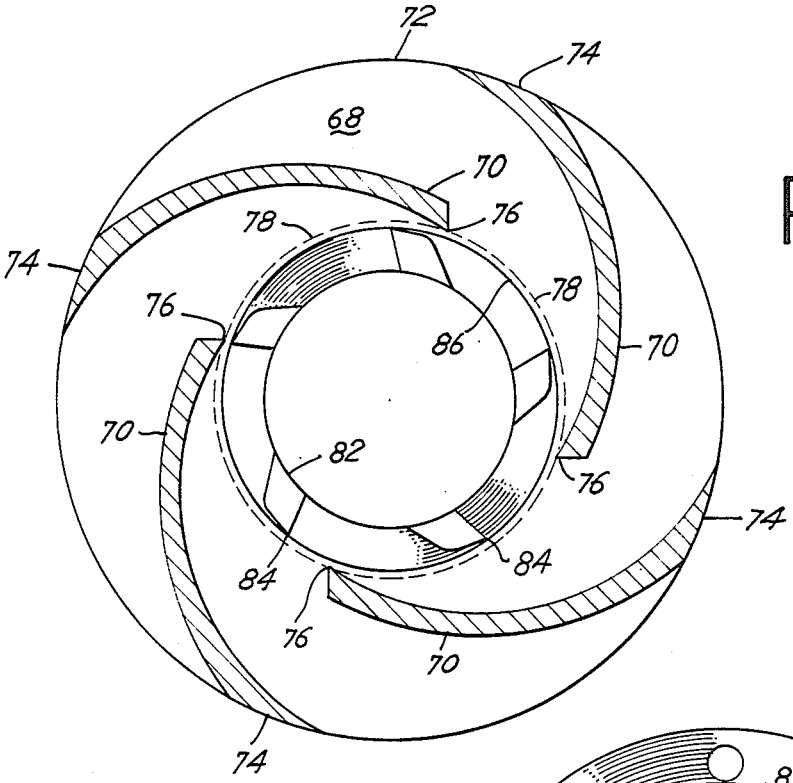
Fig. 5
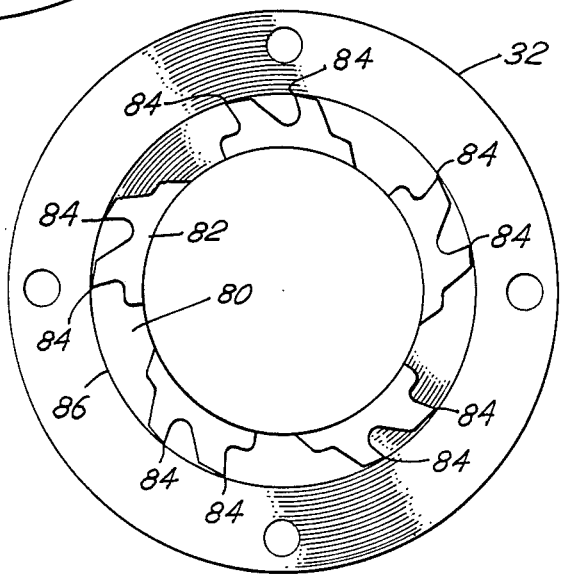
Fig. 6

CUTTER PUMP SUBASSEMBLY

BACKGROUND OF THE INVENTION

The present invention relates to an improved cutter pump subassembly for use in a centrifugal cutter pump adapted for cutting and pumping a liquid containing entrained solids, such as a slurry. Pumps of this kind are used to transport fiber suspensions and various sludges such as sewage. Particularly when pumping sewage, this type of pump must be capable of cutting not only the softer solid particles carried in the liquid but also other impurities present such as paper, cloth products, and plastics.

Previous pumps developed to pump liquids containing entrained solids suffer the disadvantages of being unduly complex, thereby being difficult to construct and expensive to maintain. These previous pumps are also tend to provide a diminished head capacity, i.e., pressure differential from suction to discharge, because the chopping action restricts the flow of the liquid.

Another problems associated with previous centrifugal cutter pumps is cavitation. Cavitation occurs when the cutting action of the pump so restricts the flow of liquid through the pump so as to cause an abnormally low pressure to exist within the pump itself. When the pressure in the pump becomes too low, vapor forms in the pump housing. This vapor formation, or cavitation, inhibits the hydro-mechanical efficiency of the pump. Moreover, instantaneous collapse of the vapor bubbles causes severe impingement on the moving and stationary parts of the pump causing excessive wear on the pump chamber and impeller. Furthermore, due to the nonuniform forces encountered thereby, severe vibration is induced which causes damage to the shaft, seals, bearings, etc.

Many pumps in the prior art offer complex cutting, shredding, or chopping apparatus. One problem associated with these pumps is that the cutting action is not carried out in line with the natural flow of the liquid passing through the pump. Thus, the liquid flow is restricted. For example, in U.S. Pat. No. 4,145,008, issued to Wolferd on Mar. 20, 1979, a pump is shown in which the chopping action of the pump is provided by a blade spinning perpendicularly to the direction of fluid flow. This blade mechanism blocks the suction port of the pump, thereby restricting the fluid flow. Additionally, when the chopping action is not in line with the natural flow of the liquid, clogging can become a problem.

Another problem associated with some prior art devices is that of vibration during operation. If the chopping or cutting action occurs asymmetrically, or off-center, it can interfere with the natural fluid flow through the pump. Thus, asymmetric forces can cause the pump to vibrate, further causing wear on the shaft, seals, bearings and blades of the pump.

Moreover, these prior art devices, because of their complex design, are relatively fragile and easily broken. When repair becomes necessary, it may be less expensive to replace the entire cutting mechanism rather than the individual blade or tooth.

The present invention provides a design of a centrifugal cutter pump subassembly that seeks to overcome the problems discussed, while at the same time providing a simple, easily constructed design that is readily adaptable to a variety of influent liquids.

SUMMARY OF THE INVENTION

Briefly, the present invention comprises an improved cutter pump subassembly for use in a centrifugal cutter pump adapted for cutting and pumping an influent liquid containing solids. In a centrifugal cutter pump, an improved cutter pump subassembly has an impeller, a stationary cutter and a housing defining a pump chamber.

The impeller is contained in the pump chamber and is provided with a plurality of spiral vanes. The vanes each have a contoured circumferential end and an inner shearing edge, the inner shearing edges defining an inner circle. The vanes each extend outwardly from the inner circle to the circumferential end. The stationary cutter has a plurality of cutting teeth, each having at least one blade. The blades define a cutting circle.

Rotation of the impeller brings the shearing edges of the impeller vanes into association with the cutter teeth blades to cut solids contained in the influent liquid. The rotation of the impeller vanes draws the liquid containing the solids into the pump chamber and cuts the solids to reduce their size. The solids are then drawn outward with the liquid and discharged through an outlet from the cutter pump subassembly.

Thus, the present invention comprises a cutter pump subassembly in which the cutting action is effected by the same moving part that performs the pumping function. Consequently, a pump incorporating the present invention can be as easily maintained as a conventional centrifugal pump of the same size that does no cutting. further, in the present invention, the cutting action occurs in line with the direction of liquid flow, thereby minimizing the power consumption during operation. Because the liquid flow is maintained in its desired path, cavitation is virtually eliminated.

Thus, it is an object of the present invention to provide an improved cutter pump subassembly for use in a centrifugal pump having a minimum of moving parts.

It is a further object of the present invention to provide a cutter pump subassembly that is simple to construct and readily maintained.

A further object of the present invention is to provide a cutter pump subassembly in which the head capacity of the pump is maximized relative to the head capacity of a similarly sized centrifugal pump having no cutter mechanism. Yet another object of the present invention is to provide a cutter pump subassembly that minimizes cavitation during use.

Still a further object of the present invention is to provide a pump wherein vibration is minimized during operation.

These and other objects, advantages, and features of the present invention will be apparent from the detailed description that follows.

BRIEF DESCRIPTION OF THE DRAWING

In the detailed description that follows, reference will be made to the drawing comprised of the following figures:

FIG. 2 is a side view cutaway of a preferred embodiment of the present invention;

FIG. 3 is a top plan view of a preferred embodiment of the prsent invention illustrating the impeller and the cutting teeth;

FIG. 4 is a side view cutaway of an alternate preferred embodiment of the present invention;

FIG. 5 is a top plan view of an alternate preferred embodiment of the present invention illustrating the stationary cutter ring; and FIG. 6 is a top plan view of another alternate preferred embodiment of the present invention illustrating the stationary cutter ring.

DETAILED DESCRIPTION OF THE PREFERRED EMBODIMENTS

Figure 1:
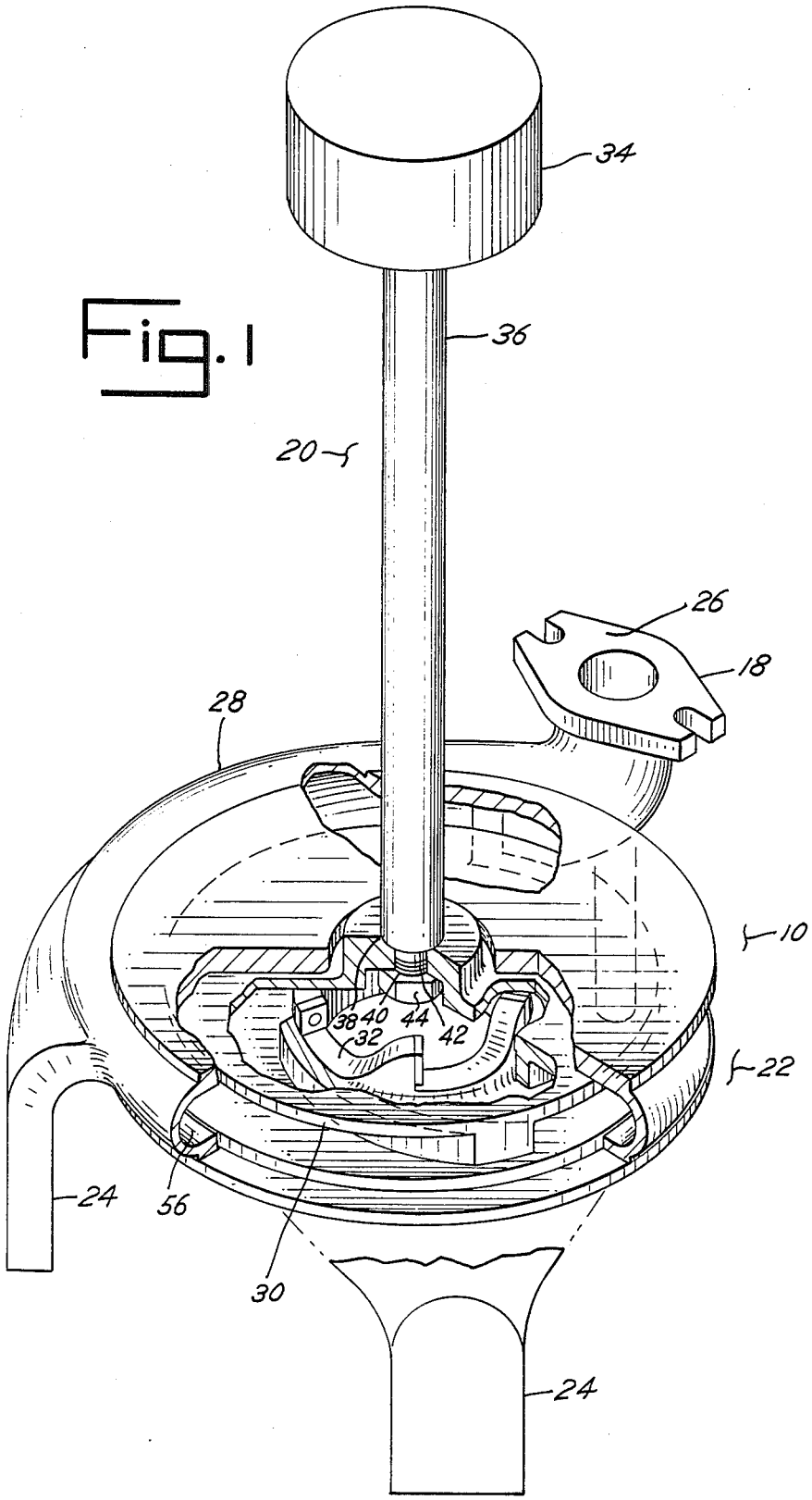
FIG. 1 is a perspective view cutaway of a chopper pump incorporating a preferred embodiment of the present invention.

As shown by FIGS. 1 and 2, a centrifugal cutter pump 10 adapted for cutting and pumping an influent liquid 12 containing solids 14 has a suction inlet 16, a discharge outlet 18, a means for driving an impeller 20 and a cutter pump subassembly 22. Legs 24 support the subassembly 22. The outlet 18 has a smooth faced flange 26 adapted to receive an external conduit.

As shown by FIG. 2, the cutter pump subassembly 22 is comprised of a housing 28, an impeller 30 and a stationary cutter 32. The means for driving an impeller 20 is shown in FIG. 1 and consists of a motor 34 connected to a drive shaft 36 which passes through the housing 28 at the shaft opening 38. The shaft 36 is connected to the impeller 30 by passage through the impeller shaft aperture 40. The shaft end has threads 42 to receive a retaining nut 44, thereby securing the drive shaft 36 to the impeller 30.

The housing 28 is provided with a suction side 46, a perimeter 48 and a closed side 50. The closed side 50 is opposite the suction side 46. The perimeter 48 is interposed between the suction side 46 and the closed side 50. The housing 28 thus defines a pump chamber 52. The suction side 46 of the housing 28 is substantially circular and has a suction aperture 54 in the center of the suction side 46. The suction aperture 54 communicates with the suction inlet 16 to permit the influent liquid 12 to pass into the pump chamber 52. The perimeter 48 is provided with a spiral channel 56, also shown in FIG. 1. As illustrated in FIG. 2, the suction side 46 of the housing 28 consists of a removable plate 58. Screws 60 pass through holes 62 in the plate 58 and into threaded apertures 64 in the housing perimeter 48. The plate 58 has a raised inner surface 66, as shown in FIG. 3.

As illustrated in FIGS. 3 and 4, the impeller 30 has a shroud 68 and a plurality of impeller vanes 70. The impeller 30 is operatively associated with the means for driving an impeller 20 so as to be rotatable thereby. An illustration of the means for driving an impeller 20 and its operative association with the impeller 30 is shown in FIGS. 1 and 2. However, it is understood that equivalent means 20 for driving the impeller 30 can be provided, such as through the use of a rotating magnetic field.

As shown in FIG. 5, the impeller shroud 68 is substantially disc shaped and has a circumference 72. The impeller vanes 70 each have a circumferential end 74 and a shearing edge 76. The vanes 70 each extend spirally outward from the shearing edge 76 to the circumferential end 74. The circumferential ends 74 are in contoured relation with the shroud circumference 72, that is, the circumferential end 74 of the impeller vanes 70 are curved so as to coincide with the shroud circumference 72 as viewed from the top. The impeller vanes 70 have their shearing edge 76 oriented inwardly to define a cutting circle 78.

Thus, the vanes 70 are attached to the impeller shroud 68. The impeller 30 is contained in the pump chamber 52 and oriented such that the shroud 68 is interposed between the impeller vanes 70 and the closed side 50 of the housing 28. The impeller vanes 70 project from the shroud 68 toward the suction side 46 of the housing 28.

As shown in FIG. 6, the stationary cutter 32 has an annular base ring 80 and a plurality of cutting teeth 82. The cutting teeth 82 each have at least one blade 84. As shown in FIG. 5, the cutting teeth 82 are each provided with one cutting blade 84. As shown in FIG. 6, the cutting teeth 82 are each provided with two cutting blades 84.

The cutting blades 84 are each equidistant from the center of the annular base ring 80 and thereby define an inner circle 86. The cutting circle 78 defined by the impeller vane shearing edges 76 is slightly larger than the inner circle 86 defined by the blades 84 of the cutter teeth 82. It is understood that the difference between the cutting circle 78 defined by the impeller vane shearing edges 76 and the inner circle 86 defined by the blades 84 of the stationary cutter teeth 82 may be varied in accordance with the skill of the art. In particular, it is noted that a preferred range of the difference between the radii of the inner circle 86 and the cutting circle 78 is between 0.002 and 0.020 inches. The impeller vanes shearing edges 76 are operatively associated with the blades 84 of the stationary cutter teeth 82 to cut solids 14 that are contained in the influent liquid 12.

FIGS. 2 and 3 illustrate a first laternate embodiment of the present invention. As shown by FIG. 2, the chopper pump subassembly 22 is comprised of a housing 28 and an impeller 30. In essence, the stationary cutter 32 shown in the embodiments illustrated in FIGS. 5 and 6 is not present in the embodiment shown in FIG. 2. Rather, the suction side 46 of the housing 28 is provided with a suction aperture 54 in the center of the suction side 46. The suction aperture 54 communicates with the suction inlet 16. A plurality of cutting teeth 82 are radially disposed about the suction aperture 54. The cutting teeth 82 each have at least one blade 84. The blades 84 are equidistant from the center of the suction aperture 54 and define an inner circle 86.

Yet another alternate embodiment of the present invention is shown in FIG. 4. The cutter teeth blades 84 are oriented substantially perpendicularly to the suction aperture 54. The shearing edges 76 of the impeller vane 70 are substantially perpendicular to the shroud 68, thereby associating with the teeth blades 84 coincidentally. Thus, the operative association of the cutter teeth 82 and the impeller vanes 70 occurs in the same direction as the influent liquid flow. Further, the number of impeller vanes 70 is equal to four. The number of cutting teeth 82 is equal to five. Thus, during rotation of the impeller 30, the operative association of the impeller vane shearing edges 76 and the cutter teeth blades 84 occurs singularly, that is, only one shearing edge 76 is in operative proximity with one cutting blade 84 at any instant in time. This embodiment minimizes the power necessary to operate the cutter pump subassembly 22.

Alternatively, it can be seen that the number of impeller vanes 70 can be divisible by or a multiple of and the number of cutting teeth 82. Although such an embodiment would require an increase in the power necessary to operate the chopper pump subassembly 22, it can be seen that vibration would be reduced due to the symmetric simultaneous operative association of the impeller vane shearing edges 76 and the respective cutter teeth blades 84.

Yet another embodiment of the present invention is illustrated by FIG. 3. The shearing edges 76 of the impeller vane 70 can be removable. Securing means 88 for securing the shearing edges 76 to the impeller vanes 70 are provided. As illustrate, the securing means 88 comprises a screw 90 and a threaded hole 92. The cutting blade 84 of the cutting teeth 82 can likewise be removable. Securing means 94 for securing the cutting blades 84 to the cutter teeth 82 are provided. As illustrated, the securing means 94 comprise a screw 96 and a threaded hole 98. By making the cutting blades 84 of the cutter teeth 82 removable, ease of maintenance and repair of the chopper pump subassembly 22 is enhanced.

Thus, the influent liquid 12 containing solids 14 enters the suction inlet 16, passes through the housing suction aperture 54 into the pump chamber 52. The liquid 12 and solids 14 are then drawn outwardly; the solids 14 are cut by the association of the stationary cutter blades 84 and the impeller vanes shearing edges 76. The liquid 12 and solids 14 are then centrifugally drawn outward by the rotation of the impeller vanes 70. The liquid 12 and solids 14 are then conducted through the spiral channel 56 and discharged from the discharge outlet 18. Note that, as shown in these various embodiments, the operative association of the impeller vane shearing edges 76 and the stationary cutter teeth blades 84 is parallel to the axis of rotation of the impeller 30, so that flow characteristics are enhanced. Further, the impeller vane shearing edges 76 and the stationary cutter teeth blades 84 extend approximately equal heights.

Various other changes may be made within the spirit and scope of the invention. Thus, the invention is to be limited only by the following claims and their equivalents.

I claim:

1. In a centrifugal cutter pump adapted for cutting and pumping an influent liquid containing solids, the cutter pump having a suction inlet, a discharge outlet, means for driving an impeller, and a cutter pump subassembly, an improved cutter pump subassembly comprising, in combination:

a housing, an impeller, and a stationary cutter;

said housing defining a pump chamber and having a suction side, a perimeter, and a closed side, said closed side being opposite the suction side, the perimeter being interposed between the suction side and the closed side, the suction side being substantially circular and having a suction aperture in substantially the center of the suction side, said suction aperture communicating with the suction inlet, the perimeter having a spiral channel;

said impeller having a shroud and a plurality of impeller vanes, the impeller operatively associated with the means for driving an impeller so as to be rotatable thereby, the shroud being disc shaped and having a circumference, the impeller vanes each having a circumferential end and a shearing edge, the vanes extending spirally outward and having their circumferential end in contoured relation with the shroud circumference, the vanes having their shearing edge oriented inwardly to define a cutting circle, the vanes being attached to the shroud, the impeller contained in the pump chamber and oriented so that the shroud is interposed between the impeller vanes and the closed side of the housing, the impeller vanes projecting from the shroud toward the suction side of the housing;

the stationary cutter being securably mountable adjacent the housing suction aperture and having an annular base ring and a plurality of cutting teeth, the cutting teeth each having at least one blade, the blades each equidistant from the center of the annular base ring and defining an inner circle, the cutting circle defined by the impeller vane shearing edges being slightly larger than the inner circle defined by the blades of the stationary cutter teeth, said impeller vane shearing edges operatively associated with said blades of the stationary cutter teeth to cut solids contained in the influent liquid, the operative association of the impeller vane shearing edges and the stationary cutter teeth blades being parallel to the axis of rotation of the impeller;

whereby the influent liquid containing solids enters the suction inlet, passes through the housing suction aperture into the pump chamber, is drawn outwardly and cut by the association of the stationary cutter blades and the impeller vane shearing edges, is centrifugally drawn outward by the rotation of the impeller vanes, is conducted through the spiral channel and is discharged from the discharge outlet.

2. The improvement of claim 1 wherein the radius of the cutting circle defined by the impeller vane shearing edges is less than 0.020 inches greater than the radius of the inner circle defined by the stationary cutting teeth blades.

3. The improvement of claim 1 wherein the number of impeller vanes is greater than two and less than eight.

4. The improvement of claim 3 wherein the number of cutting teeth is greater than two and less than eight.

5. The improvement of claim 4 wherein the number of impeller vanes differs from the number of cutting teeth.

6. The improvement of claim 5 wherein the relative number of impeller vanes and cutting teeth is such that the operative association of the vanes and teeth occurs singularly.

7. The improvement of claim 1 wherein the number of cutting teeth is greater than two and less than eight.

8. The improvement of claim 1 wherein each cutting tooth has one blade.

9. The improvement of claim 1 wherein each cutting tooth has two blades.

10. The improvement of claim 1 wherein the shearing edges of the impeller blades are removable and have securing means for securing them to the impeller blades.

11. The improvement of claim 1 wherein the blades of the cutting teeth are removable and have securing means for securing them to the cutting teeth.

12. In a centrifugal cutter pump adapted for cutter and pumping an influent liquid containing solids, the cutter pump having a suction inlet, a discharge outlet, means for driving an impeller, and a cutter pump subassembly, an improved cutter pump subassembly comprising, in combination:

a housing and an impeller;

the housing defining a pump chamber and having a suction side, a perimeter having a spiral channel, and a closed side, said closed side being opposite the suction side, the perimeter being interposed between the suction side and the closed side, the suction side being substantially circular and having a suction aperture in substantially the center of the suction side, said suction aperture communicating with the suction inlet, and a plurality of cutting teeth radially disposed about the suction aperture, the cutting teeth each having at least one blade, the blades each equidistant from the center of the suction aperture and defining an inner circle;

the impeller having a shroud and a plurality of impeller vanes, the impeller operatively associated with the means for driving an impeller so as to be rotatable thereby, the shroud being disc shaped and having a circumference, the impeller vanes each having a circumferential end and a shearing edge, the vanes extending spirally outward and having their circumferential end in contoured relation with the shroud circumference, the vanes having their shearing edge oriented inwardly to define a cutting circle, the vanes being attached to the shroud, the impeller being contained in the pump chamber and oriented so that the shroud is interposed between the impeller vanes and the closed side of the housing, the impeller vanes projecting from the shroud toward the suction side of the housing;

the cutting circle defined by the impeller vane shearing edges being slightly larger than the inner circle defined by the blades of the cutting teeth, said impeller vane shearing edges operatively associated with said blades of the cutting teeth to cut solids contained in the influent liquid, the operative association of the impeller vane shearing edges and the stationary cutter teeth blades being parallel to the axis of rotation of the impeller;

whereby the influent liquid containing solids enters the suction inlet, passes through the housing suction aperture into the pump chamber, is drawn outwardly and cut by the association of the cutting teeth blades and the impeller vane shearing edges, is centrifugally drawn outward by the rotation of the impeller vanes, is conducted through the spiral channel and is discharged from the discharge outlet.

13. The improvement of claim 12 wherein the radius of the cutting circle defined by the impeller vane shearing edges is less than 0.020 inches greater than the radius of the inner circle defined by the stationary cutting teeth blades.

14. The improvement of claim 12 wherein the number of impeller vanes is greater than two and less than eight.

15. The improvement of claim 14 wherein the number of cutting teeth is greater than two and less than eight.

16. The improvement of claim 15 wherein the number of impeller vanes differs from the number of cutting teeth.

17. The improvement of claim 16 wherein the relative number of impeller vanes and cutting teeth is such that the operative association of the vanes and teeth occurs singularly.

18. The improvement of claim 12 wherein the number of cutting teeth is greater than two and less than eight.

19. The improvement of claim 12 wherein each cutting tooth has one blade.

20. The improvement of claim 12 wherein each cutting tooth has two blades.

21. The improvement of claim 12 wherein the shearing edges of the impeller blades are removable and have securing means for securing them to the impeller blades.

22. The improvement of claim 12 wherein the blades of the cutting teeth are removable and having securing means for securing them to the cutting teeth.

23. In a centrifugal cutter pump adapted for cutting and pumping an influent liquid containing solids, the cutter pump having a suction inlet, a discharge outlet, means for driving an impeller, and a cutter pump subassembly, an improved cutter pump subassembly comprising, in combination:

a housing, an impeller, and a stationary cutter;

said housing defining a pump chamber and having a suction side, a perimeter, and a closed side, said closed side being opposite the suction side, the perimeter being interposed between the suction side and the closed side, the suction side being substantially circular and having a suction aperture in substantially the center of the suction side, said suction aperture communicating with the suction inlet, the perimeter having a spiral channel;

said impeller having a shroud and a plurality of impeller vanes, the impeller operatively associated with the means for driving an impeller so as to be rotatable thereby, the shroud being disc shaped and having a circumference the impeller vanes each having a circumferential end and a shearing edge, the vanes extending spirally outward and having their circumferential end in contoured relation with the shroud circumference, the vanes having their shearing edge oriented inwardly to define a cutting circle, the vanes being attached ot the shroud, the impeller being contained in the pump chamber and oriented so that the shroud is interposed between the impeller vanes and the closed side of the housing, the impeller vanes projecting from the shroud toward the suction side of the housing;

the stationary cutter being securably mountable adjacent the housing suction aperture and having an annular base ring and a plurality of cutting teeth, the cutting teeth each extending approximately the same height as the shearing edges of the impeller vanes, the cutting teeth each having at least one blade, the blades each equidistant from the center of the annular base ring and defining an inner circle, the cutting circle defined by the impeller vane shearing edges being slightly larger than the inner circle defined by the blades of the stationary cutter teeth, said impeller vane shearing edges operatively associated with said blades of the stationary cutter teeth to cut solids contained in the influent liquid, the operative association of the impeller vane shearing edges and the stationary cutter teeth blades being parallel to the axis of rotation of the impeller;

whereby the influent liquid containing solids enters the suction inlet, passes through the housing suction aperture into the pump chamber, is drawn outwardly and cut by the association of the stationary cutter blades and the impeller vane shearing edges, is centrifugally drawn outward by the rotation of the impeller vanes, is conducted through the spiral channel and is discharged from the discharge outlet.

24. In a centrifugal cutter pump adapted for cutter and pumping an influent liquid containing solids, the cutter pump having a suction inlet, a discharge outlet, means for driving an impeller, and a cutter pump subassembly, an improved cutter pump subassembly comprising, in combination:

a housing and an impeller;

the housing defining a pump chamber and having a suction side, a perimeter having a spiral channel, and a closed side, said closed side being opposite the suction side, the perimeter being interposed between the suction side and the closed side, the suction side being substantially circular and having a suction aperture in substantially the center of the suction side, said suction aperture communicating with the suction inlet, and a plurality of cutting teeth radially disposed about the suction aperture, the cutting teeth each having at least one blade, the blades each equidistant from the center of the suction aperture and defining an inner circle;

the impeller having a shroud and a plurality of impeller vanes, the impeller operatively associated with the means for driving an impeller so as to be rotatable thereby, the shroud being disc shaped and having a circumference, the impeller vanes each having a circumferential end and a shearing edge, the vanes extending spirally outward and having their circumferential end in contoured relation with the shroud circumference, the vanes having their shearing edge oriented inwardly to define a cutting circle, the vanes being attached to the shroud, the impeller being contained in the pump chamber and oriented so that the shroud is interposed between the impeller vanes and the closed side of the housing, the impeller vanes projecting from the shroud toward the suction side of the housing;

the cutting teeth each extending approximately the same height as the shearing edges of the impeller vanes;

the cutting circle defined by the impeller vane shearing edges being slightly larger than the inner circle defined by the blades of the cutting teeth, said impeller vane shearing edges operatively associated with said blades of the cutting teeth to cut solids contained in the influent liquid, the operative association of the impeller vane shearing edges and the stationary cutter teeth blades being parallel to the axis of rotation of the impeller;

whereby the influent liquid containing solids enters the suction inlet, passes through the housing suction aperture into the pump chamber, is drawn outwardly and cut by the association of the cutting teeth blades and the impeller vane shearing edges, is centrifugally drawn outward by the rotation of the impeller vanes, is conducted through the spiral channel and is discharged from the discharge outlet

* * * * *